US007800562B2

(12) United States Patent
Asano

(10) Patent No.: US 7,800,562 B2
(45) Date of Patent: Sep. 21, 2010

(54) DISPLAY DEVICE

(75) Inventor: Mitsuru Asano, Kanagawa (JP)

(73) Assignee: Sony Corporation, Tokyo (JP)

( * ) Notice: Subject to any disclaimer, the term of this patent is extended or adjusted under 35 U.S.C. 154(b) by 526 days.

(21) Appl. No.: 11/873,726

(22) Filed: Oct. 17, 2007

(65) Prior Publication Data

US 2008/0094425 A1 Apr. 24, 2008

(30) Foreign Application Priority Data

Oct. 18, 2006 (JP) ..... P2006-283412

(51) Int. Cl.
*G09G 3/30* (2006.01)

(52) U.S. Cl. ..... 345/77; 345/83

(58) Field of Classification Search ..... 345/690, 345/211, 212, 82, 83, 87–89, 76, 77
See application file for complete search history.

(56) References Cited

U.S. PATENT DOCUMENTS 6,750,839 B1 * 6/2004 Hogan ..... 345/98
2002/0063674 A1 * 5/2002 Chiang ..... 345/98
2004/0189574 A1 * 9/2004 Lee et al. ..... 345/95
2004/0212574 A1 * 10/2004 Iwasaki ..... 345/87
2005/0231409 A1 * 10/2005 Yamaguchi et al. ..... 341/144
2006/0176074 A1 * 8/2006 Van Epps et al. ..... 326/30
2007/0040855 A1 * 2/2007 Kato ..... 345/690

FOREIGN PATENT DOCUMENTS

JP 2000-324508 11/2000

* cited by examiner

*Primary Examiner*—Ricardo L Osorio
(74) *Attorney, Agent, or Firm*—Sonnenschein Nath & Rosenthal LLP

(57) ABSTRACT

In an embodiment of the present invention, basic reference voltages VRT, VRB, VR, VG, and VB are divided by resistors to produce plural reference voltages V0 to V15, and voltages are selected from these plural reference voltages V0 to V15 for digital-analog conversion processing of image data DR, DG, and DB. At least the basic reference voltage VRB for the black level is shared by the respective color data DR, DG, and DB. The basic reference voltages VR, VG, and VB for setting of an intermediate grayscale closer to the black level can be varied individually for each of the color data DR, DG, and DB. When this embodiment is applied to a display device employing current-driven light-emitting elements such as organic EL elements, contrast deterioration due to floating black and sinking black can be prevented with a simple configuration.

5 Claims, 16 Drawing Sheets

DISPLAY DEVICE

CROSS REFERENCES TO RELATED APPLICATIONS

The present invention contains subject matter related to Japanese Patent Application JP 2006-283412 filed with the Japan Patent Office on Oct. 18, 2006, the entire contents of which being incorporated herein by reference.

BACKGROUND OF THE INVENTION

1. Field of the Invention

The present invention relates to display devices and can be applied to a display device that employs current-driven light-emitting elements such as organic electro luminescence (EL) elements. In an embodiment of the present invention, basic reference voltages are divided by resistors to thereby produce plural reference voltages, and voltages are selected from the plural reference voltages for digital-analog conversion processing of image data. In particular, at least the basic reference voltage for the black level is shared by the respective color data, and the basic reference voltages for setting of an intermediate grayscale closer to the black level can be varied individually for each color data. This feature can prevent contrast deterioration due to floating black (unfavorably-bright black) and sinking black (unfavorably-dark black) with a simple configuration.

2. Description of the Related Art

In a related-art display device such as a liquid crystal display, a driver for driving a liquid crystal display panel is provided with a gamma correction circuit, and the signal level of an input signal is corrected by this gamma correction circuit to thereby assure a desired gamma. The gamma γ is expressed by Equation (1), in which IN indicates the signal level of an input signal and Y indicates the output luminance value. In a typical display device, the gamma γ is set to 2.2.

$$IN \propto Y^{\gamma} \qquad \text{Equation (1)}$$

Regarding the gamma correction in liquid crystal displays and so on, various improvements have been proposed in Japanese Patent Laid-open No. 2000-324508 and so on.

FIG. 15 is a connection diagram showing the configuration of one pixel in a display device employing organic EL elements. In the display device employing organic EL elements, pixels 1 are arranged in a matrix to thereby form a display part for displaying images.

In the pixel 1, a series circuit of a drive transistor Tr2 formed of e.g. a p-channel MOS transistor and an organic EL element 2 is provided between supply voltages VDD1 and VSS1. In the pixel 1, the gate of the drive transistor Tr2 is connected via a transistor Tr1 to a signal line sig. When the transistor Tr1 is turned on by a control signal VSCAN1, the gate of the drive transistor Tr2 is connected to the signal line sig, so that the potential of the signal line sig is held in a capacitor CS1 connected to the gate of the drive transistor Tr2. The drive transistor Tr2 drives the organic EL element 2 with the gate voltage dependent upon the potential of the signal line sig held in this capacitor CS1. Based on this driving, the pixel 1 causes the organic EL element 2 to emit light with the luminance value dependent upon a data voltage VDATA applied to the signal line sig.

The light emission characteristic of the organic EL element 2 is expressed by Equation (2), in which L indicates the light emission luminance value of the organic EL element 2 and I indicates the current value of the organic EL element. In Equation (2), β is represented by the equation $\beta=\mu\cdot Cox\cdot W/L$, in which μ is the mobility of the drive transistor Tr2, Cox is the unit capacitance of the gate oxide film of the drive transistor Tr2, W is the gate width of the drive transistor Tr2, and L is the gate length of the drive transistor Tr2. Furthermore, Vdata indicates the data voltage (the signal level of an input signal), and Vth indicates the threshold voltage of the drive transistor Tr2.

$$L \propto I = \beta/2\cdot(Vdata - Vth)^2 \qquad \text{Equation (2)}$$

Applying Equation (2) to Equation (1) makes it apparent that the gamma γ of the organic EL element 2 is 2.0. Consequently, the display device employing the organic EL elements 2 can display images with a substantially appropriate gamma without provision of a gamma correction circuit.

However, in a practical organic EL element 2, the luminance value on the black side often deviates to a higher value from its ideal characteristic expressed by Equation (2), which leads to contrast deterioration. Hereinafter, this phenomenon will be referred to as floating black.

Specifically, in the display device employing the organic EL elements, a thin film transistor (TFT) is used as the drive transistor Tr2. The IV characteristic of the TFT in the saturation region is expressed by Equation (3). FIG. 16 is a characteristic curve diagram showing the IV characteristic of the TFT. In Equation (3), Ids indicates the drain current and Vgs indicates the gate-source voltage.

$$Ids = \beta/2\cdot(Vgs - Vth)^2 \qquad \text{Equation (3)}$$

However, the TFT involves the subthreshold region in a lower-current region in particular. As shown by the dashed line in FIG. 16, the IV characteristic often deviates from the ideal characteristic expressed by Equation (3) in this subthreshold region. As a result, the floating black phenomenon will occur in the display device employing the organic EL elements.

The IL characteristic of the organic EL element 2 is expressed by Equation (4). In Equation (4), L indicates the luminance value, I indicates the current, and ϕ indicates the efficiency.

$$L = \phi\cdot I \qquad \text{Equation (4)}$$

The efficiency ϕ is a constant ideally. However, in practice, it often changes depending on the current, and very often changes in a lower-current region in particular. As this change, the efficiency decreases as shown in FIG. 17 in most cases. When the efficiency decreases on the lower current side, the black side sinks (becomes darker), contrary to the floating black, and thus the contrast deteriorates.

SUMMARY OF THE INVENTION

There is a need for the present invention to provide a display device that is allowed to prevent contrast deterioration due to floating black and sinking black with a simple configuration.

According to an embodiment of the present invention, there is provided a display device in which image data is subjected to digital-analog conversion processing to produce a drive signal and a display part formed by arranging pixels each employing a current-driven light-emitting element in a matrix is driven based on the drive signal. The display device includes a basic reference voltage generation circuit configured to generate a plurality of basic reference voltages by varying a voltage in accordance with control data, a plurality of voltage divider circuits configured to each produce a plurality of reference voltages by dividing the plurality of basic reference voltages by resistors, for a respective one of color data included in the image data, and a selection circuit configured to select, for each of the color data, voltages from the plurality of reference voltages in accordance with the color data to produce the drive signal. At least the basic reference voltage for the black level is shared by the respective colors. The basic reference voltages for setting of an intermediate grayscale closer to the black level (on the black level side) are varied individually for each of the color data so as to be supplied to the voltage divider circuits.

In this configuration, at least the basic reference voltage corresponding to the black level is supplied to the plurality of voltage divider circuits in common, and thus a simplified configuration can be achieved. In addition, the basic reference voltages closer to the black level than the voltage corresponding to the center value of the drive signal are each supplied to a respective one of the plurality of voltage divider circuits for a respective one of the color data. This can prevent floating black and sinking black in the pixels of the respective colors and thus can prevent contrast deterioration.

According to the embodiment of the present invention, contrast deterioration due to floating black and sinking black can be prevented with a simple configuration.

DETAILED DESCRIPTION OF THE PREFERRED EMBODIMENTS

Embodiments of the present invention will be described in detail below with reference to the accompanying drawings.

First Embodiment

(1) Configuration of Embodiment

Figure 2:
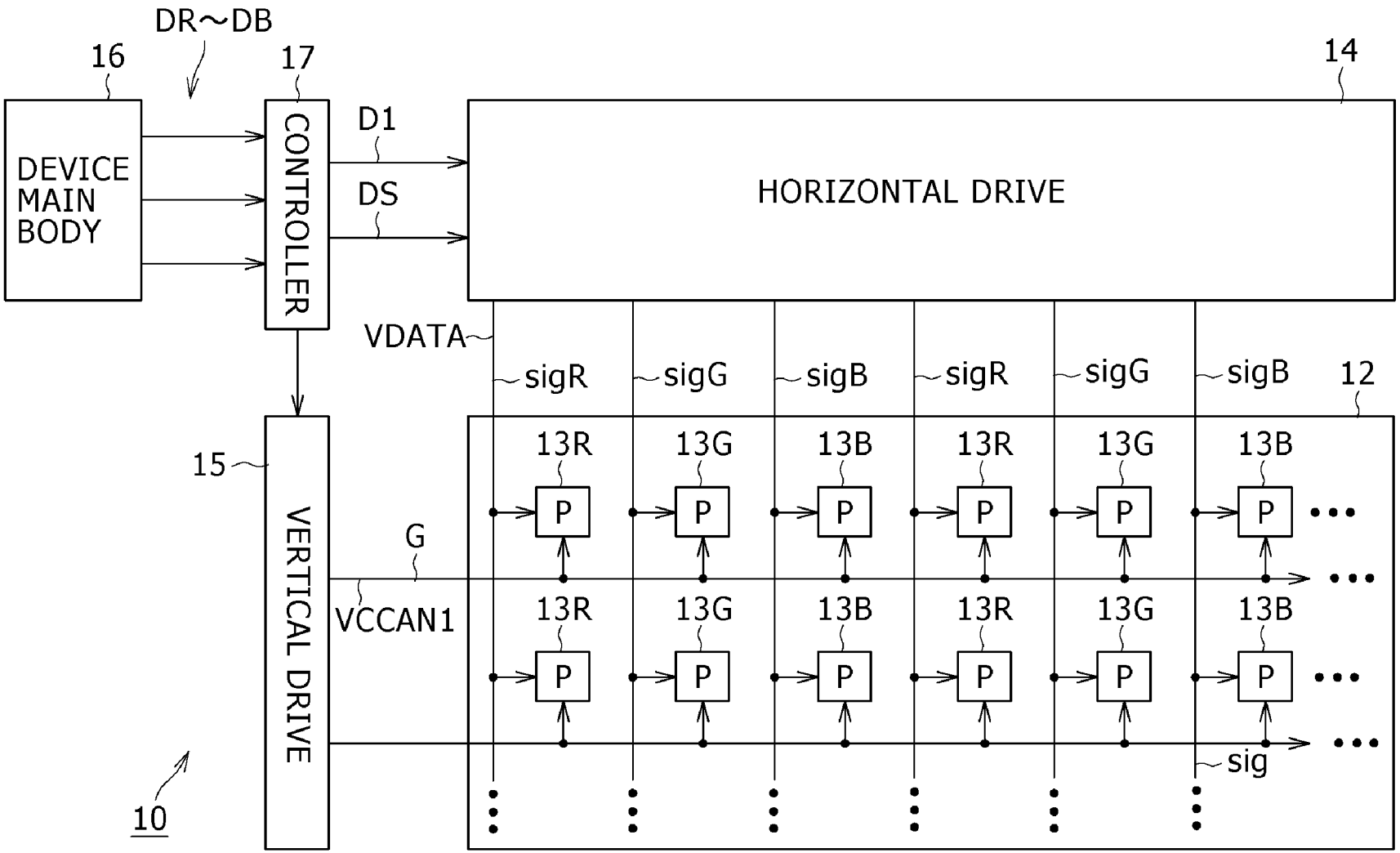
FIG. 2 is a block diagram showing the display device according to the first embodiment of the present invention.

FIG. 2 is a block diagram showing a display device according to a first embodiment of the present invention. In this display device 10, TFTs and so on are sequentially fabricated on an insulating substrate such as a glass substrate, so that red, green, and blue pixels 13R, 13G, and 13B are arranged in a matrix for formation of a display part 12. In the display device 10, each of the pixels 13R, 13G, and 13B in this display part 12 is connected to a horizontal drive circuit 14 and a vertical drive circuit 15 via a signal line (column line) sig (sigR, sigG, sigB) and a scan line (row line) G, respectively. In this display device 10, the pixels 13R, 13G, and 13B are sequentially selected by the vertical drive circuit 15, and the grayscales of the respective pixels 13R, 13G, and 13B are set based on drive signals from the horizontal drive circuit 14, so that a desired color image is displayed.

For this displaying, in the display device 10, image data DR, DG, and DB as the color data of red, green, and blue, respectively, are input from a device main body 16 to a controller 17 simultaneously in parallel. Furthermore, a timing signal synchronized with the image data DR, DG, and DB is generated by the vertical drive circuit 15 for driving of the scan lines G of the display part 12. In addition, the image data DR, DG, and DB are so subjected to time division multiplexing for creation of one-series image data D1 that the image data D1 will match with the driving by the vertical drive circuit 15. Based on the image data D1, the signal lines sig are driven by the horizontal drive circuit 14.

Figure 15:
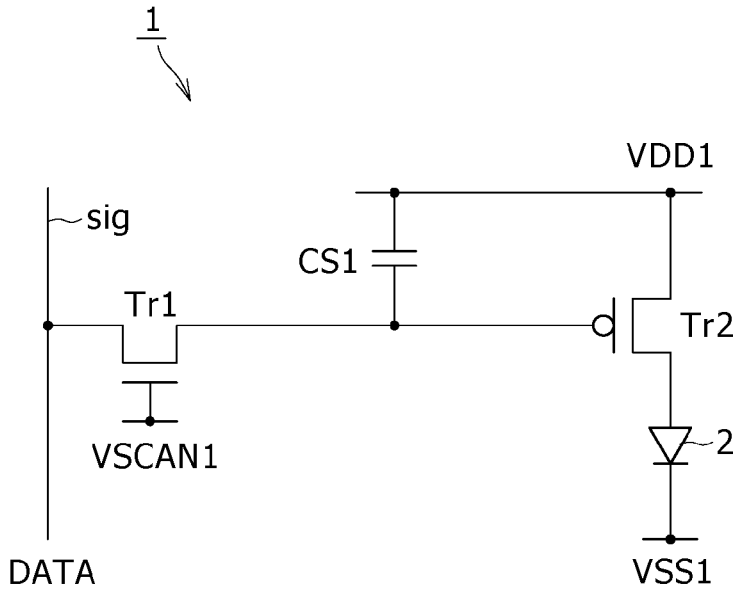
FIG. 15 is a connection diagram showing a pixel in which an organic EL element is used.

Each of the pixels 13R, 13G, and 13B is formed to have the same configuration as that of the above-described pixel 1 in FIG. 15, except that the pixels 13R, 13G, and 13B are each provided with the organic EL element 2 of the corresponding light emission color.

Figure 3:
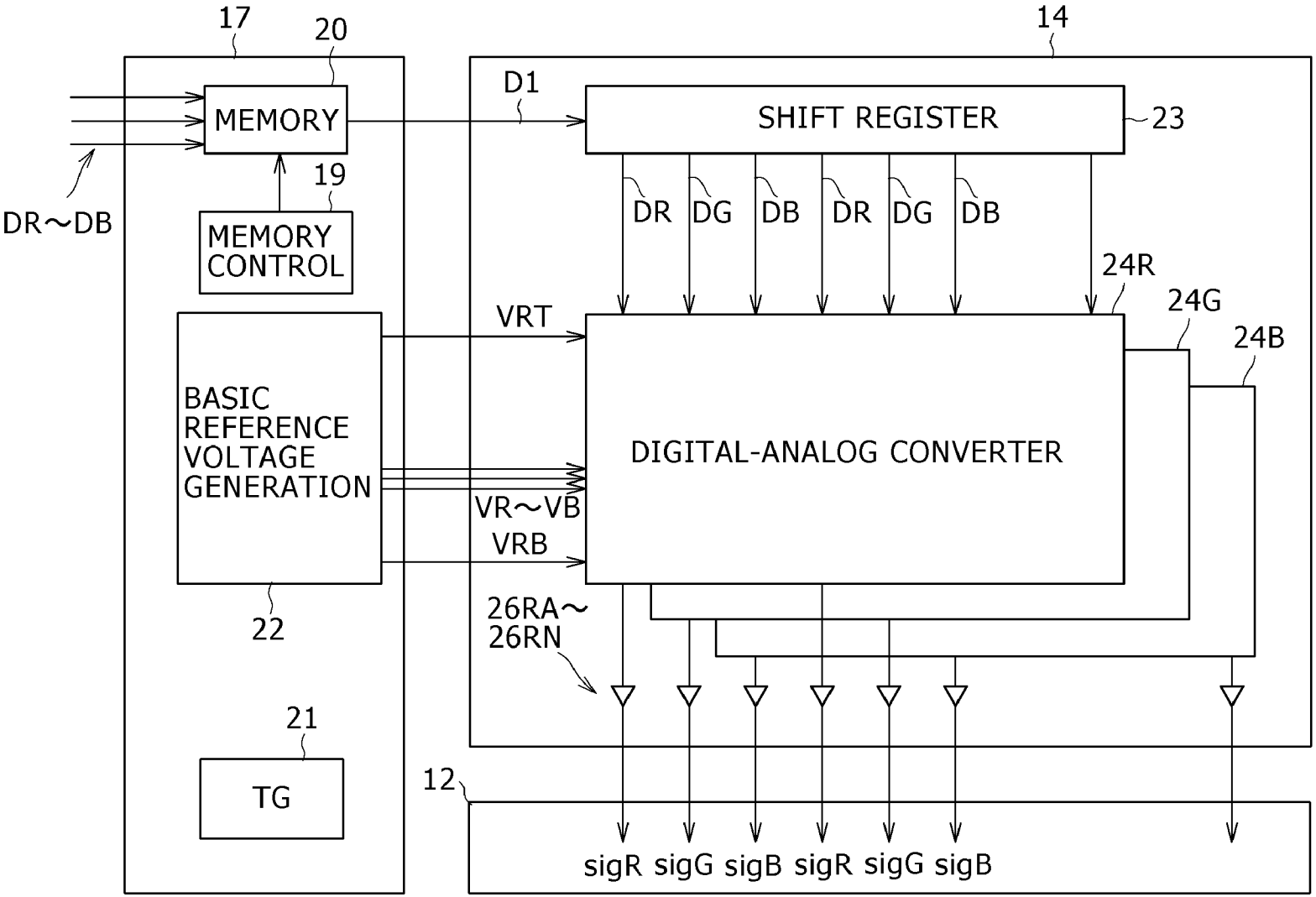
FIG. 3 is a block diagram showing a controller and a horizontal drive circuit in the display device of FIG. 2.

FIG. 3 is a block diagram showing the horizontal drive circuit 14 and the controller 17 in detail. In the controller 17, the image data DR, DG, and DB output from the device main body 16 are sequentially stored in a memory 20 under control by a memory control circuit 19. Furthermore, the image data DR, DG, and DB are so subjected to time division multiplexing that the resultant data will match with the driving of the signal lines sig, so that the image data D1 is output.

In addition, a timing generator (TG) 21 in the controller 17 generates various kinds of timing signals synchronized with the image data D1 and outputs the timing signals to the horizontal drive circuit 14 and the vertical drive circuit 15. Moreover, a basic reference voltage generation circuit 22 in the controller 17 generates basic reference voltages VRT, VR to VB, and VRB serving as the basis for production of reference voltages for digital-analog conversion processing, and outputs these basic reference voltages to the horizontal drive circuit 14.

The horizontal drive circuit 14 inputs the image data D1 output from the controller 17 to a shift register 23, and sequentially distributes the image data D1 (DR, DG, DB) to the respective channels of the signal lines sig. Digital-analog converters 24R, 24G, and 24B execute digital-analog conversion processing for the red, green, and blue image data DR, DG, and DB, respectively, output from the shift register 23, to thereby produce drive signals for the respective signal lines sig (sigR, sigG, sigB). Amplifier circuits 26RA to 26RN, 26GA to 26GN, and 26BA to 26BN amplify the output signals from the digital-analog converters 24R, 24G, and 24B, respectively, and output the amplified signals to the display part 12.

Figure 1:
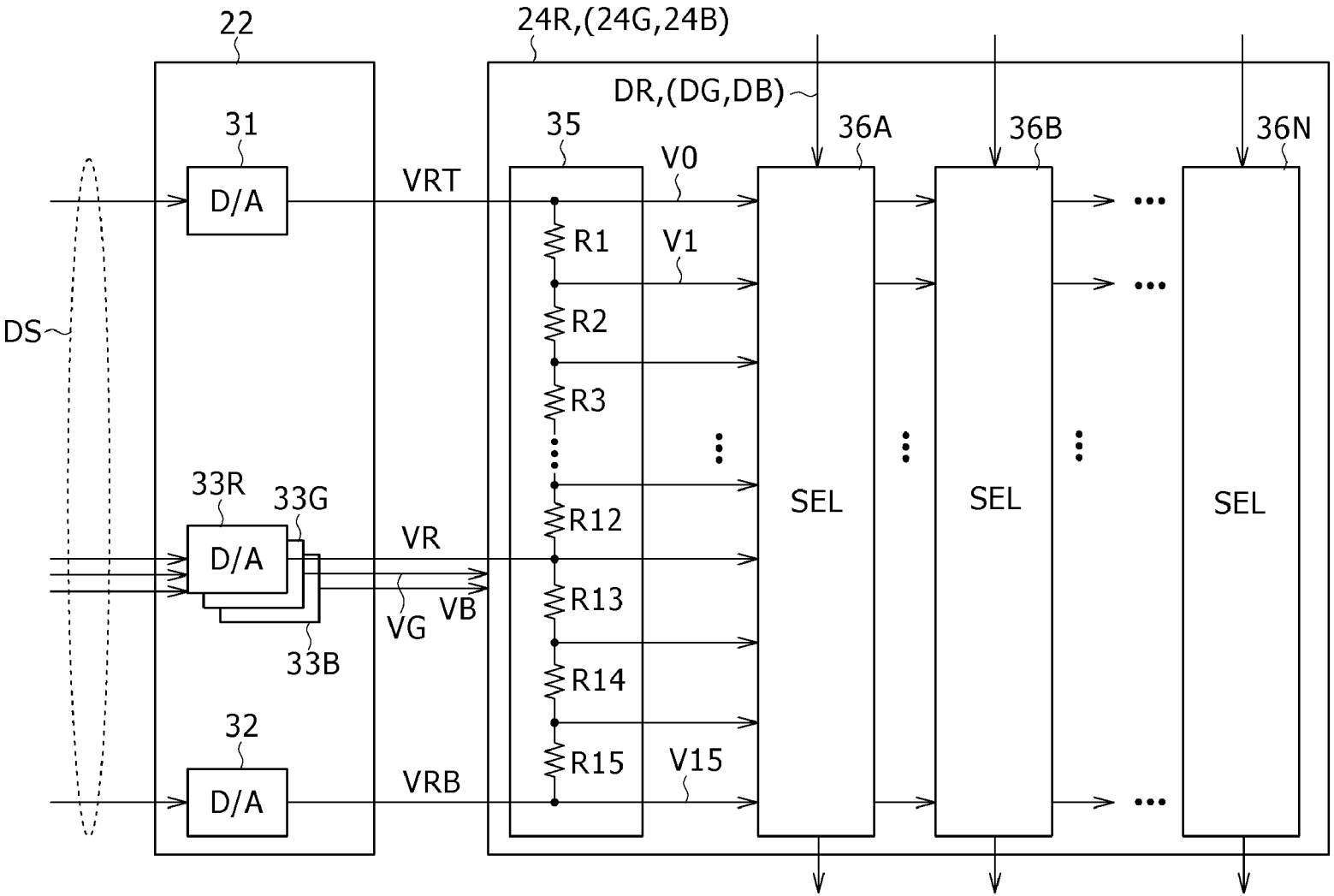
FIG. 1 is a block diagram showing a basic reference voltage generation circuit and a digital-analog converter in a display device according to a first embodiment of the present invention.

FIG. 1 is a block diagram showing the configurations of the basic reference voltage generation circuit 22 and the digital-analog converters 24R, 24G, and 24B in detail. The basic reference voltage generation circuit 22 generates the basic reference voltages VRT, VR to VB, and VRB depending on control data DS output from the controller 17. Specifically, in the basic reference voltage generation circuit 22, a digital-analog conversion circuit (D/A) 31 generates the basic reference voltage VRT for setting of the white level in accordance with the control data DS, and a digital-analog conversion circuit (D/A) 32 generates the basic reference voltage VRB for setting of the black level in accordance with the control data DS. On the other hand, digital-analog conversion circuits (D/A) 33R, 33G, and 33B generate the basic reference voltages VR, VG, and VB for setting of intermediate grayscales of red, green, and blue, respectively, in accordance with the control data DS.

The basic reference voltages VR, VG, and VB for setting of an intermediate grayscale are voltages for adjusting floating black and sinking black. Therefore, the basic reference voltages VR, VG, and VB for setting of an intermediate grayscale are each set to a voltage closer to the black level than the center voltage between the white level and the black level.

The digital-analog converters 24R, 24G, and 24B produce reference voltages V0 to V15 for digital-analog conversion processing from the basic reference voltages VRT, VR to VB, and VRB generated by the basic reference voltage generation circuit 22. Furthermore, the digital-analog converters 24R, 24G, and 24B select voltages from the reference voltages V0 to V15 depending on the image data DR, DG, and DB, and output the selected voltages to the signal lines sig. The digital-analog converters 24R, 24G, and 24B are formed to have the same configuration, except for the difference among the basic reference voltages VR, VG, and VB for setting of an intermediate grayscale, used to produce the reference voltages V0 to V15. Therefore, in the following, the digital-analog converter 24R for red will be described in detail, and overlapping description for the other digital-analog converters 24G and 24B will be omitted.

The digital-analog converter 24R inputs to a reference voltage production circuit 35 the basic reference voltage VRT for setting of the white level, the basic reference voltage VRB for setting of the black level, and the basic reference voltage VR for setting of an intermediate grayscale, to thereby produce the reference voltages V0 to V15. Specifically, in the reference voltage production circuit 35, a voltage divider circuit is formed through connection of a predetermined number of resistors R1 to R15 each having a predetermined resistance value in series to each other. The basic reference voltage VRT for setting of the white level and the basic reference voltage VRB for setting of the black level are input to both the ends of this voltage divider circuit. The voltages of both the ends of the voltage divider circuit and the voltages of the nodes between respective two of the resistors R1 to R15 are output as the reference voltages V0 to V15. The basic reference voltage VR for setting of an intermediate grayscale is input to a predetermined position that is closer than the center of the series circuit of the resistors R1 to R15 to the node to which the basic reference voltage VRB for setting of the black level is input.

In the digital-analog converter 24R, selectors (SEL) 36A to 36N each select one of the reference voltages V0 to V15 in accordance with the image data DR that are output from the shift register 23 in such a manner as to be distributed to the respective signal lines sig, so that the image data DR are subjected to digital-analog conversion processing to thereby produce drive signals. The digital-analog converter 24R outputs the respective drive signals to the corresponding amplifier circuits 26RA to 26RN.

In adjustment operation at the time of factory shipment, the control data DS is recorded and held in the memory of the controller 17 for setting of the basic reference voltages VRT, VRB, and VR to VB. When the power supply of the display device 10 is activated, the control data DS recorded in the memory is set in the digital-analog conversion circuits 31, 32, and 33R to 33B. Thus, as shown by the arrowheads in FIG. 4, in this display device 10, the white level and the black level of the red, green, and blue pixels 13R, 13G, and 13B are collectively adjusted based on the setting of this control data DS. In contrast, for floating black and sinking black, the basic reference voltages VR, VG, and VB can be adjusted individually for the red, green, and blue pixels 13R, 13G, and 13B, respectively, based on the setting of this control data DS.

(2) Operation of Embodiment

In this display device 10 (FIG. 2) having the above-described configuration, the image data DR to DB to be used for displaying are input from the device main body 16 to the controller 17 and are subjected to time division multiplexing in the controller 17, followed by being input to the horizontal drive circuit 14. In this horizontal drive circuit 14 (FIG. 3), the image data D1 is loaded into the shift register 23 so as to be distributed to the respective signal lines sig. In the digital-analog converters 24R, 24G, and 24B of the respective colors, the image data DR, DG, and DB distributed to the respective signal lines sig are subjected to digital-analog conversion processing to thereby produce drive signals for the signal lines sig. These drive signals are output via the amplifier circuits 26RA to 26BN to the signal lines sig of the display part 12. In each of the pixels 13R, 13G, and 13B (FIG. 15), the potential of the signal line sig, which changes in response to the output of the drive signal, is held in the capacitor CS1 through the turn-on operation of the transistor Tr1, so that the drive transistor Tr2 drives the organic EL element 2 with the gate voltage equivalent to the voltage held in the capacitor CS1. This operation allows the display device 10 to display an image based on the image data DR, DG, and DB.

Figure 16:
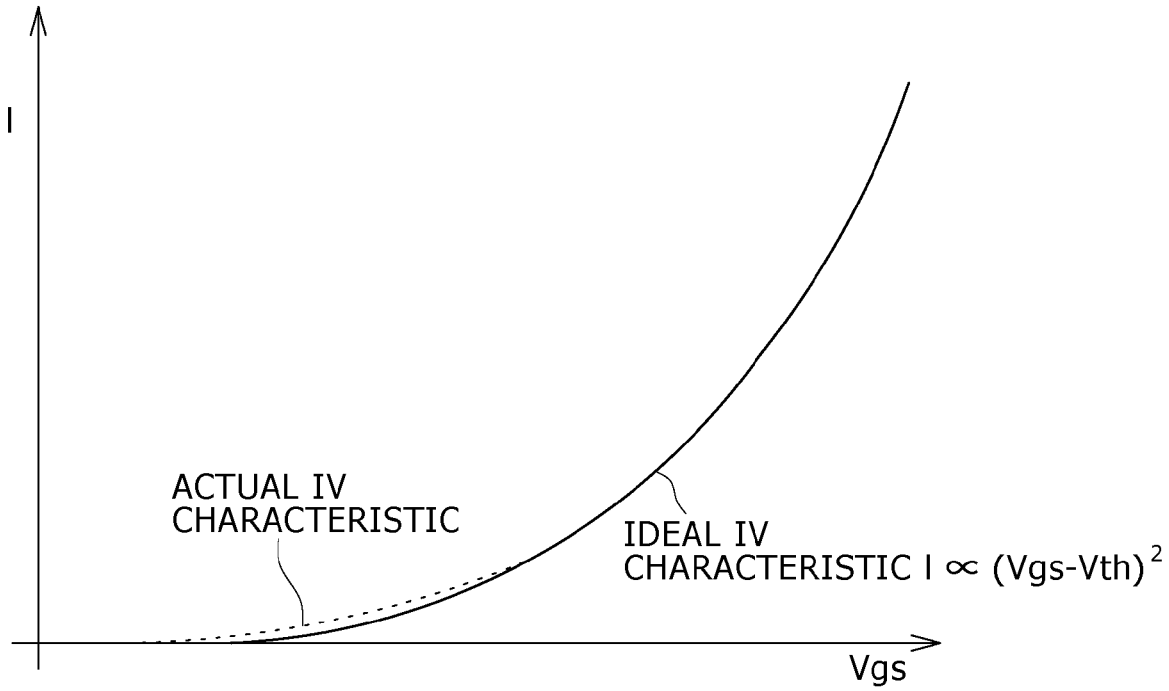
FIG. 16 is a characteristic curve diagram showing a characteristic of a TFT.
Figure 17:
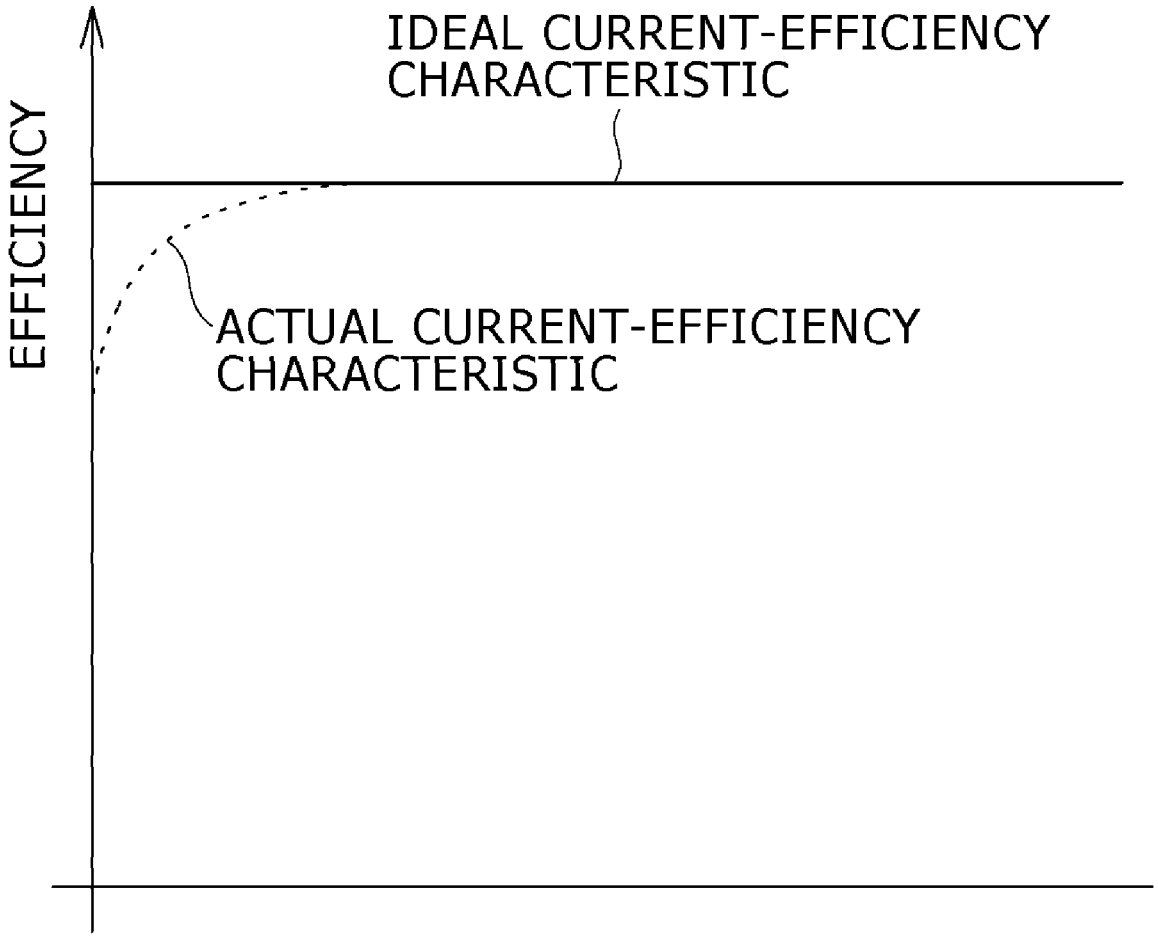
FIG. 17 is a characteristic curve diagram showing the efficiency.

In this display device 10, the organic EL element 2 is driven by the drive transistor Tr2 as a TFT. As described above with FIG. 16, the light emission luminance L of the organic EL element 2 changes in proportion to the square of the value obtained by subtracting the threshold voltage Vth of the drive transistor Tr2 from the gate-source voltage Vgs thereof, which is equivalent to the potential difference across the capacitor that holds the potential of the signal line sig (Equation (2)). Therefore, in the display device 10, a gamma characteristic of $\gamma=2$ can be assured without provision of a gamma correction circuit, and thus color reproducibility sufficient for practical use can be assured.

However, the organic EL element 2 involves the possibility of the occurrence of floating black and sinking black. In particular, the occurrence of the sinking black significantly deteriorates the visual image quality. Furthermore, in a precise sense, a gamma characteristic of $\gamma=2.2$ is demanded. Therefore, no gamma correction means slight deterioration of the color reproducibility.

To address these problems, in this display device 10 (FIG. 1), a voltage divider circuit is formed by employing a series circuit of the plural resistors R1 to R15 in each of the digital-analog converters 24R, 24G, and 24B. Furthermore, the selectors 36A to 36N select voltages from the reference voltages V0 to V15 produced by the voltage divider circuit, so that the image data DR, DG, and DB are subjected to digital-analog conversion processing. This feature allows this display device 10 to assure a desired gamma characteristic through setting of the voltage division ratio of the voltage divider circuit formed of the resistors R1 to R15.

Furthermore, the basic reference voltage generation circuit 22 generates, in accordance with the control data DS, the basic reference voltage VRT for setting of the white level and the basic reference voltage VRB for setting of the black level, which are input to both the ends of the voltage divider circuit. This makes it possible to adjust the white level and the black level based on the setting of the control data DS. In the digital-analog converters 24R, 24G, and 24B of the respective color data, the reference voltage production circuit 35 produces the reference voltages V0 to V15. The basic reference voltage VRT for setting of the white level and the basic reference voltage VRB for setting of the black level are used in common by these digital-analog converters 24R, 24G, and 24B. Thus, in this display device 10, the white level and the black level are adjusted in common to the respective color data as shown by the arrowheads in FIG. 4, which indicate potential changes due to drive signal adjustment. This feature allows simplified adjustment operation and configuration.

Figure 4:
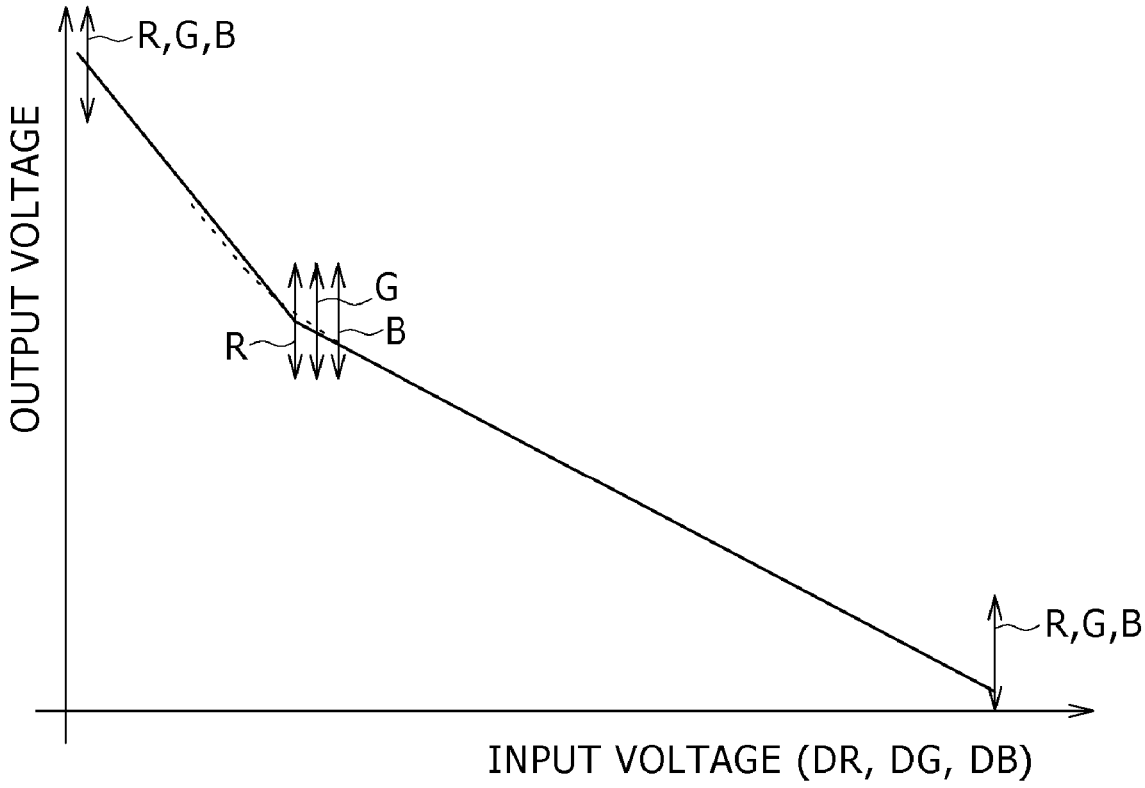
FIG. 4 is a characteristic curve diagram for explaining gamma adjustment in the display device of FIG. 2.

Furthermore, in the display device 10, the digital-analog conversion circuits 33R, 33G, and 33B in the basic reference voltage generation circuit 22 generate, in accordance with the control data DS, the basic reference voltages VR, VG, and VB for setting of intermediate grayscales of red, green, and blue. These basic reference voltages VR, VG, and VB are each output to a node between voltage-dividing resistors closer to the black level side than the center grayscale of the voltage divider circuit. Due to this operation, in the display device 10, the gamma characteristic is set as a so-called one-point broken line characteristic, and adjustment for floating black and sinking black can be carried out for each of the red, green, and blue pixels as shown in FIG. 4.

In addition, in this embodiment, not only the floating black and the sinking black but also the white balance in the vicinity of the black can be adjusted through the control of the basic reference voltages VR, VG, and VB for setting of an intermediate grayscale based on the control data DS. The disturbance of the white balance is characteristically more noticeable in the vicinity of the black level than in the vicinity of the white level. Thus, the display device 10 can express grayscales more accurately with a simple configuration compared with related-art displays.

(3) Advantageous Effects of Embodiment

In the above-described configuration, basic reference voltages are divided by resistors to thereby produce plural reference voltages, and voltages are selected from the plural reference voltages for digital-analog conversion processing of image data. In particular, at least the basic reference voltage for the black level is shared by the respective color data, and the basic reference voltages for setting of an intermediate grayscale closer to the black level can be varied individually for each color data. This feature can prevent contrast deterioration due to floating black and sinking black with a simple configuration. Furthermore, through the application of a voltage for intermediate grayscale adjustment for each color data, the white balance in the vicinity of the black level can be finely adjusted to thereby obtain a further enhanced image quality.

Second Embodiment

Figure 5:
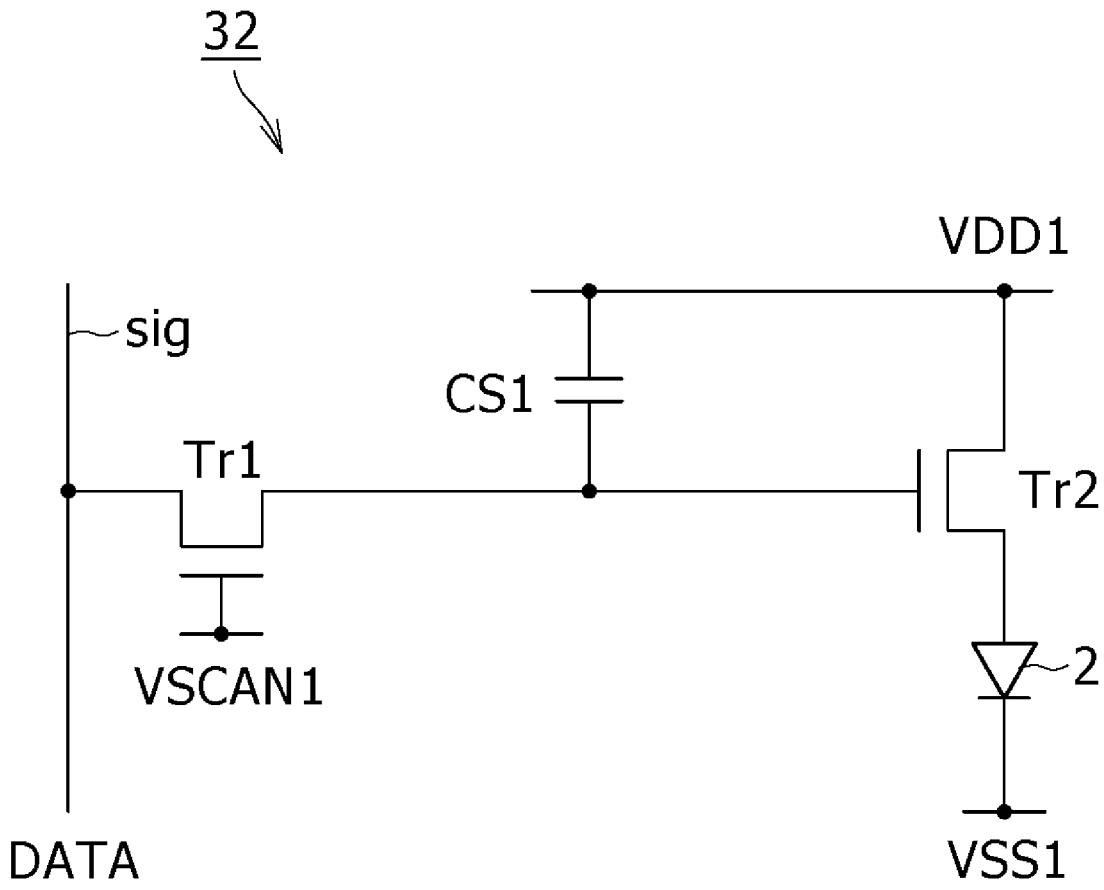
FIG. 5 is a connection diagram showing a pixel in a display device according to a second embodiment of the present invention.
Figure 6:
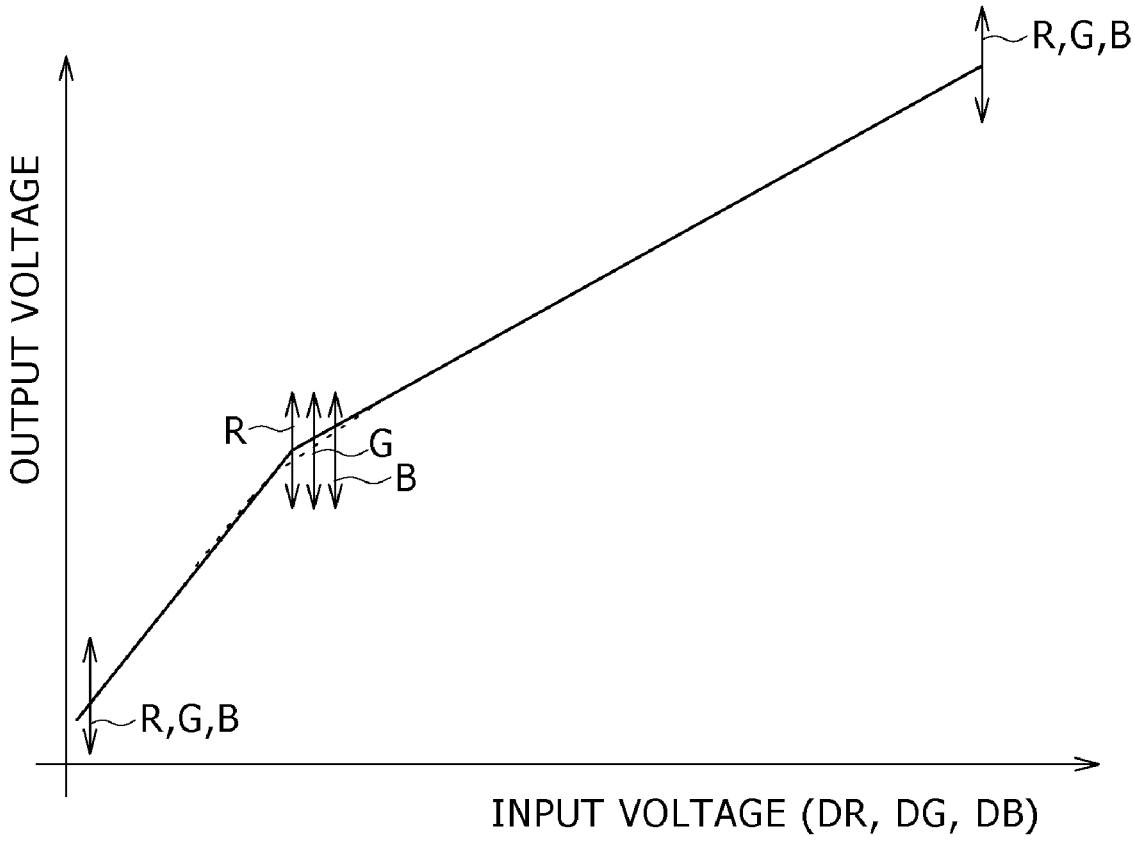
FIG. 6 is a characteristic curve diagram for explaining gamma adjustment in the display device according to the second embodiment of the present invention.

FIG. 5 is a connection diagram showing a pixel applied to a display device according to a second embodiment of the present invention. In a pixel 32 of this embodiment, a drive transistor Tr2 is formed of an n-channel MOS transistor. Therefore, the respective components are so formed that, as shown in FIG. 6 as comparison with FIG. 4, the relationship between the light emission luminance of the pixel and the potential of a signal line sig will be opposite to that in the display device 10 of the above-described first embodiment.

Also in the case in which a drive transistor is formed of an n-channel MOS transistor like in this embodiment, the same advantages as those by the first embodiment can be achieved.

Third Embodiment

Figure 7:
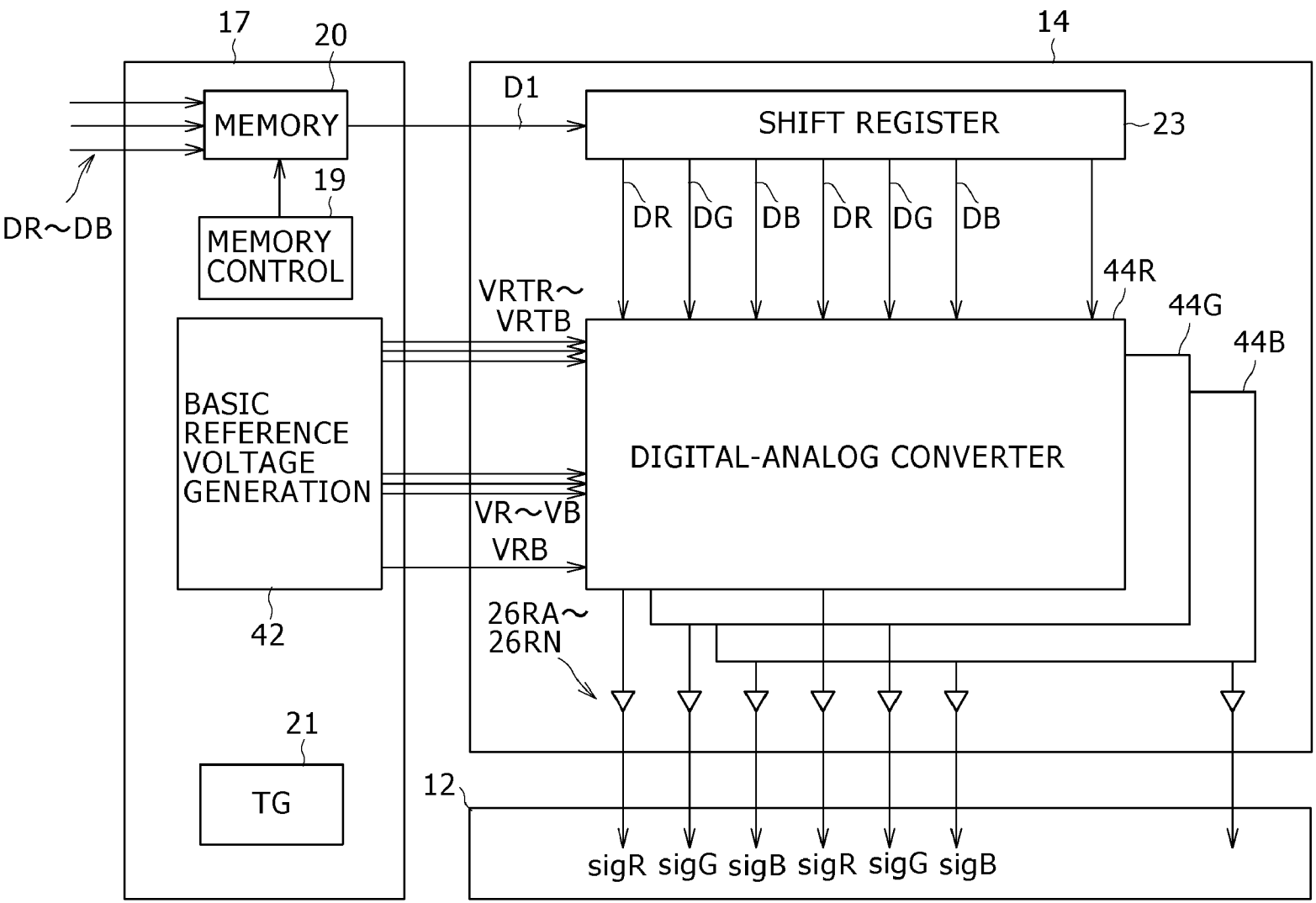
FIG. 7 is a block diagram showing a controller and a horizontal drive circuit in a display device according to a third embodiment of the present invention.
Figure 8:
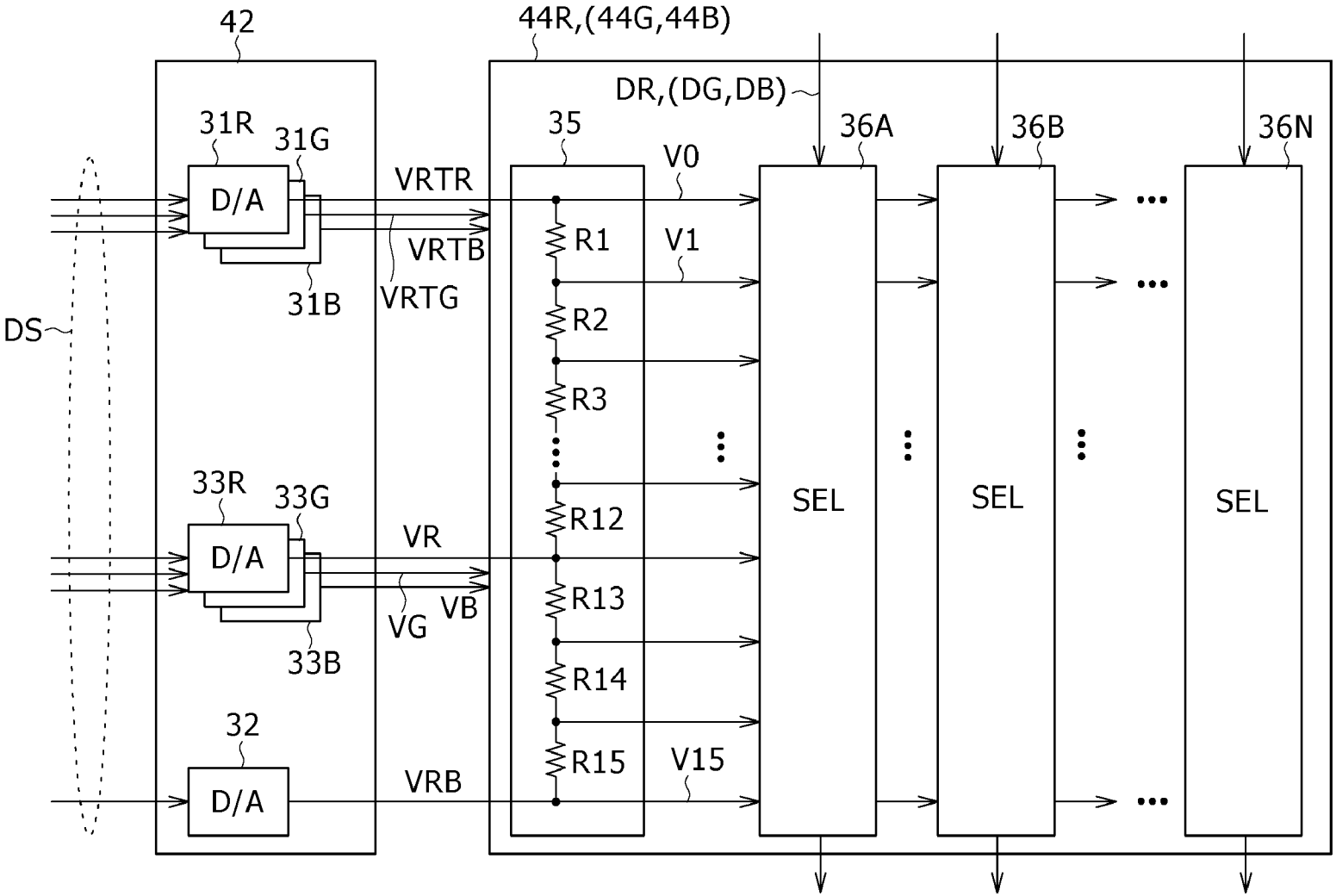
FIG. 8 is a block diagram showing a basic reference voltage generation circuit and a digital-analog converter in the display device of FIG. 7.

FIGS. 7 and 8 are block diagrams showing, based on comparison with FIGS. 1 and 3, a partial configuration of a display device according to a third embodiment of the present invention. In this display device, for the respective color data, a basic reference voltage generation circuit 42 generates basic reference voltages VRTR, VRTG, and VRTB for setting of the white levels for red, green, and blue, respectively. Furthermore, red, green, and blue digital-analog converters 44R, 44G, and 44B produce reference voltages V0 to V15 by using these basic reference voltages VRTR, VRTG, and VRTB for setting of the white levels for red, green, and blue. This can adjust the white level as well as an intermediate level near the black level on a color-by-color basis.

According to this embodiment, not only an intermediate level near the black level but also the white level can be adjusted on a color-by-color basis, which can further enhance the color reproducibility.

Fourth Embodiment

Figure 9:
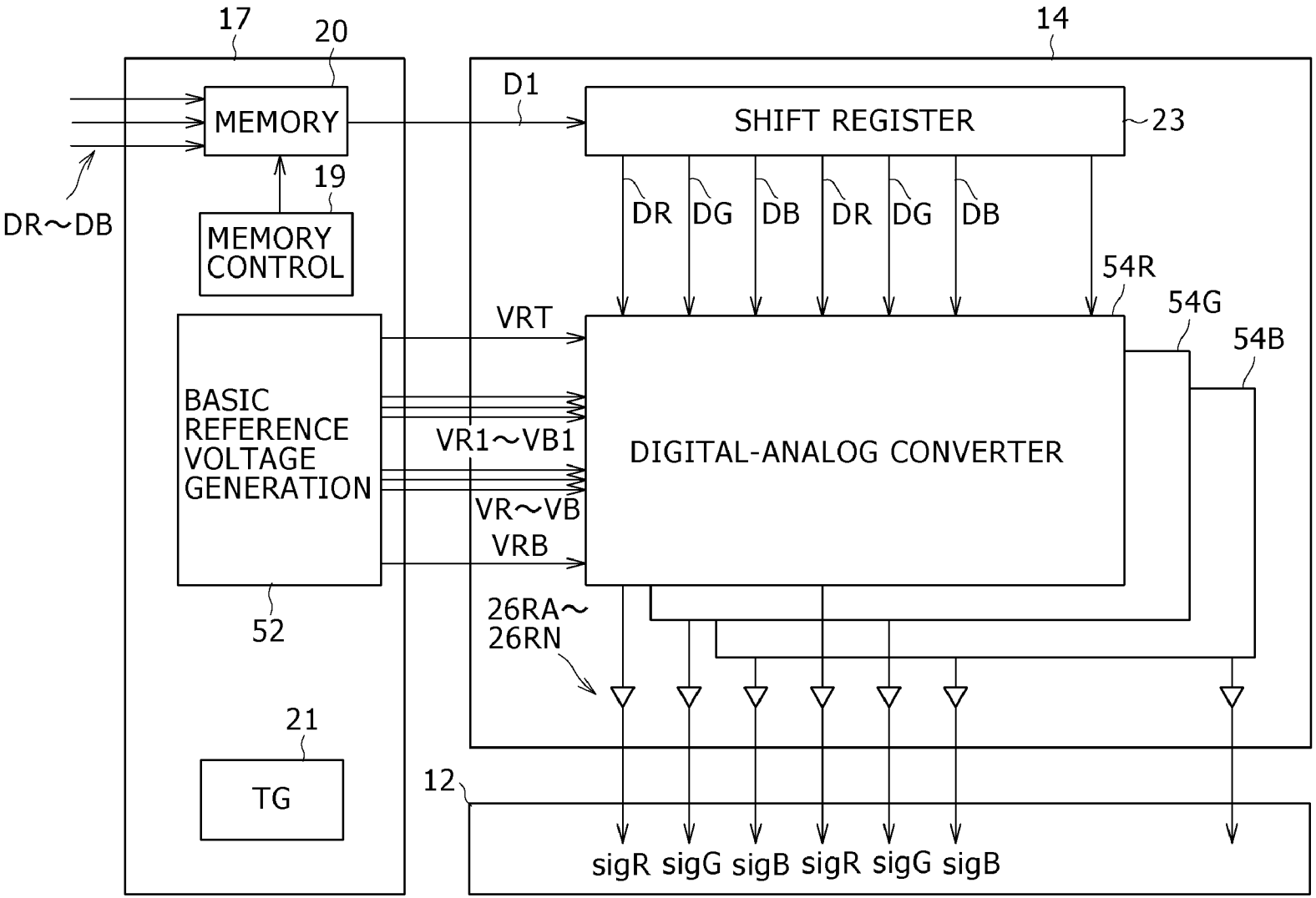
FIG. 9 is a block diagram showing a controller and a horizontal drive circuit in a display device according to a fourth embodiment of the present invention.
Figure 10:
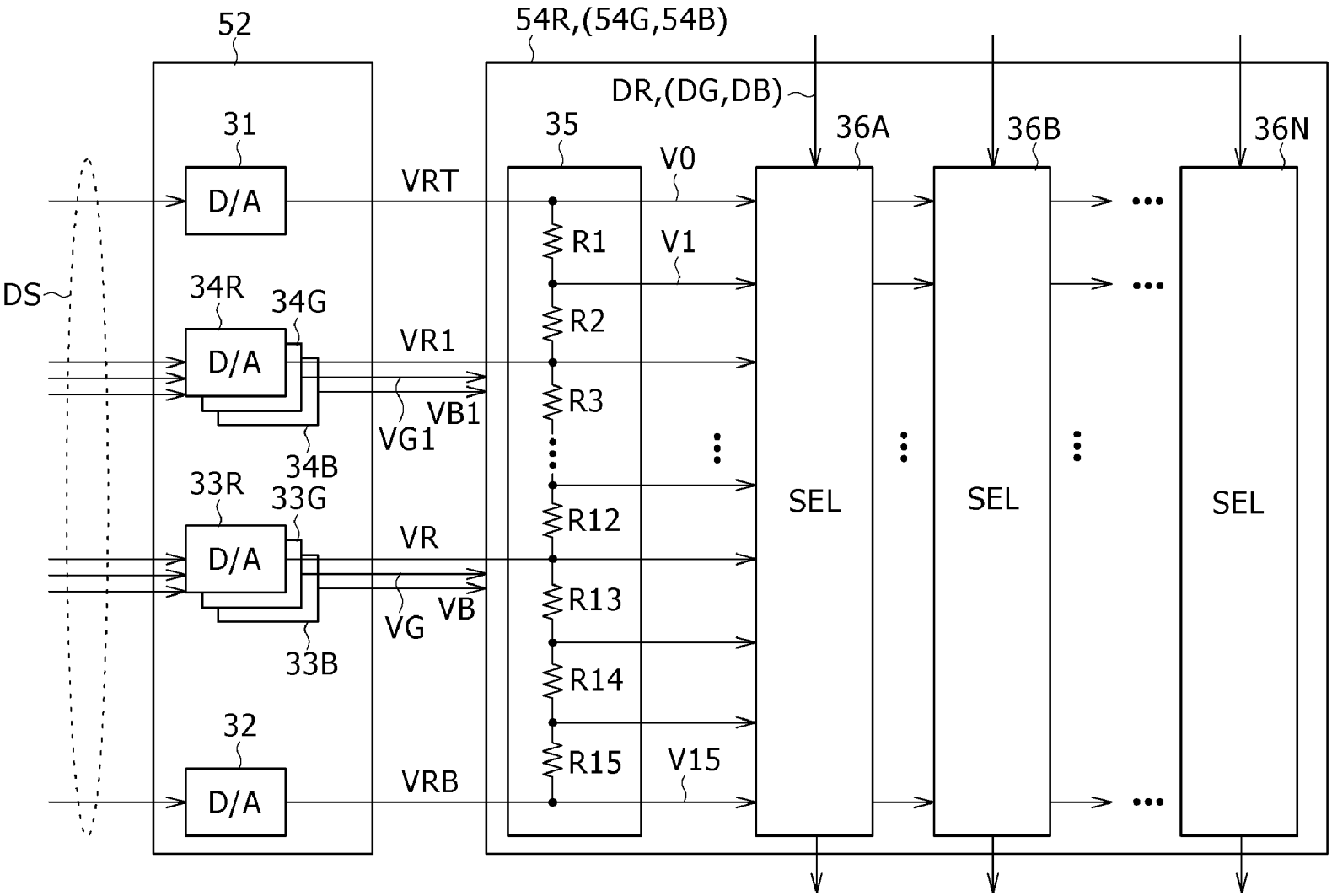
FIG. 10 is a block diagram showing a basic reference voltage generation circuit and a digital-analog converter in the display device of FIG. 9.

FIGS. 9 and 10 are block diagrams showing, based on comparison with FIGS. 1 and 3, a partial configuration of a display device according to a fourth embodiment of the present invention. In this display device, a basic reference voltage generation circuit 52 further generates basic reference voltages VR1, VG1, and VB1 for red, green, and blue, closer to the white than the center grayscale. Furthermore, red, green, and blue digital-analog converters 54R, 54G, and 54B produce reference voltages V0 to V15 by using a basic reference voltage VRT for setting of the white level, the basic reference voltages VR1, VG1, and VB1 closer to the white than the center grayscale, basic reference voltages VR, VG, and VB closer to the black than the center grayscale, and a basic reference voltage VRB for setting of the black level.

Figure 11:
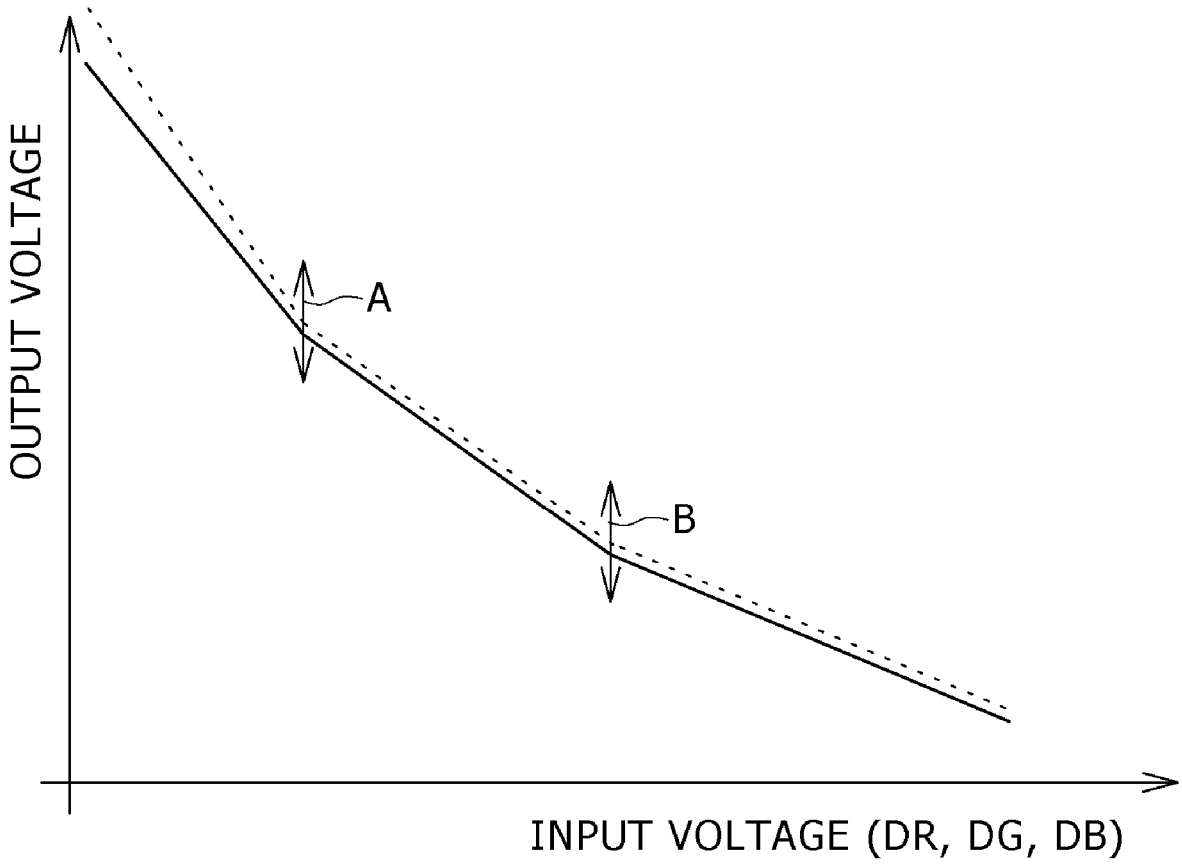
FIG. 11 is a characteristic curve diagram for explaining gamma adjustment in the display device according to the fourth embodiment of the present invention.

Due to this feature, in the display device of this embodiment, as shown in FIG. 11, the gamma characteristic is set as a so-called two-point broken line characteristic in such a way that intermediate grayscales closer to the black level and closer to the white level can be adjusted on a color-by-color basis.

Also when the gamma characteristic is set as a two-point broken line characteristic like in this embodiment, the same advantages as those by the first embodiment can be achieved. Furthermore, the gamma can be adjusted more finely compared with the first embodiment.

Fifth Embodiment

Figure 12:
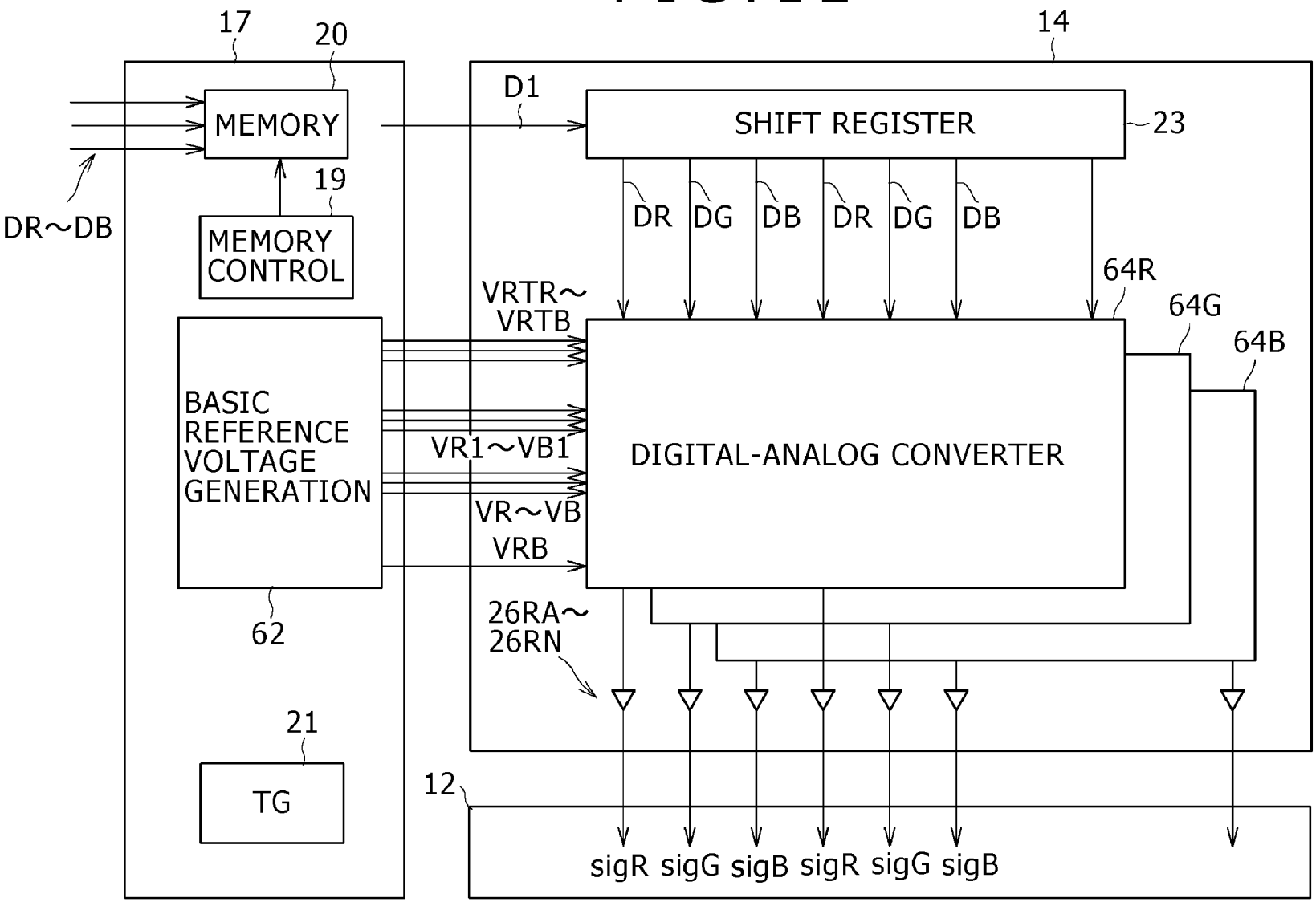
FIG. 12 is a block diagram showing a controller and a horizontal drive circuit in a display device according to a fifth embodiment of the present invention.
Figure 13:
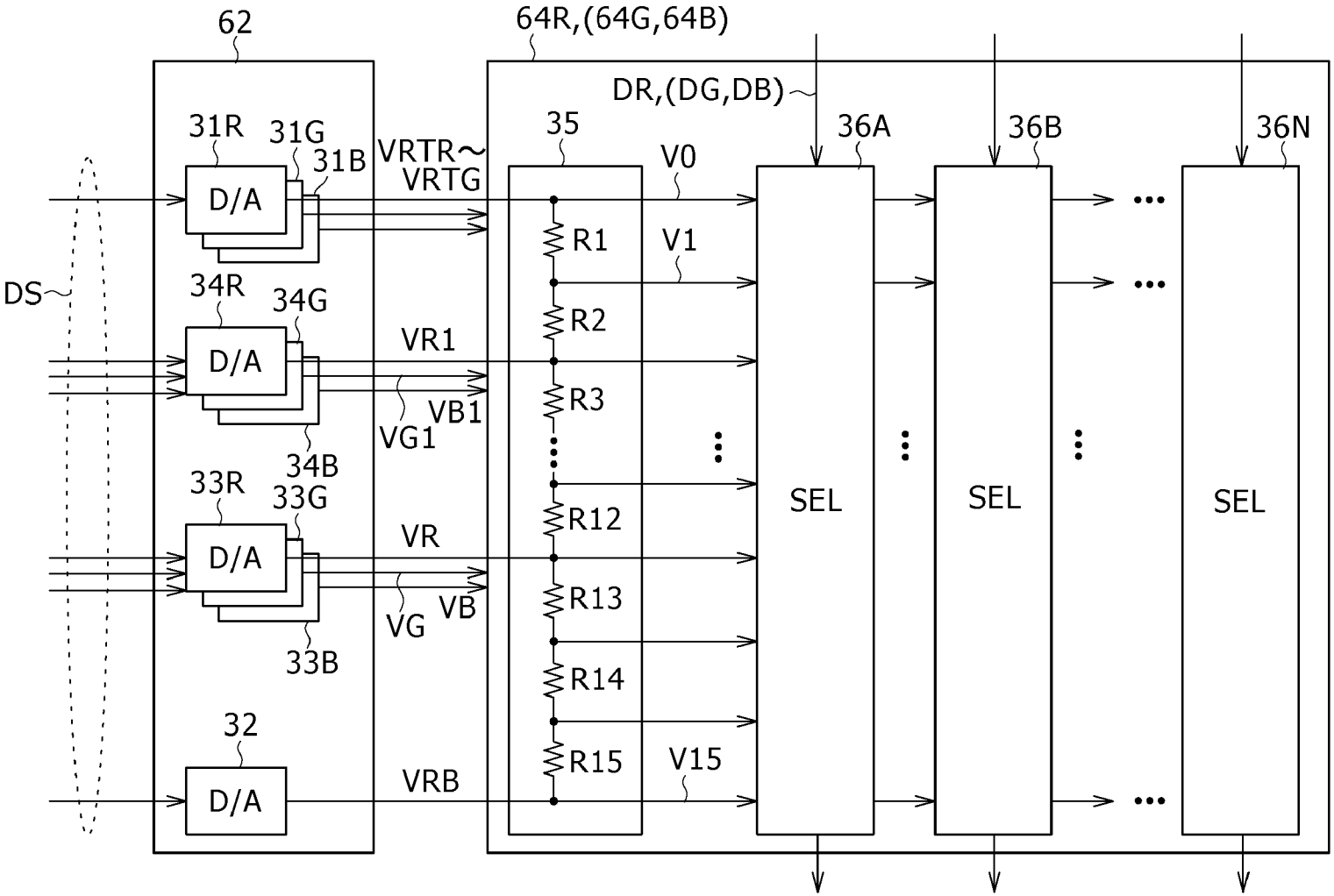
FIG. 13 is a block diagram showing a basic reference voltage generation circuit and a digital-analog converter in the display device of FIG. 12.

FIGS. 12 and 13 are block diagrams showing, based on comparison with FIGS. 9 and 10, a partial configuration of a display device according to a fifth embodiment of the present invention. In this display device, a basic reference voltage generation circuit 62 further generates basic reference voltages VRTR, VRTG, and VRTB for setting of the white levels for the respective colors. Furthermore, red, green, and blue digital-analog converters 64R, 64G, and 64B produce reference voltages V0 to V15 by using the basic reference voltages VRTR, VRTG, and VRTB for setting of the white level, basic reference voltages VR1, VG1, and VB1 closer to the white than the center grayscale, basic reference voltages VR, VG, and VB closer to the black than the center grayscale, and a basic reference voltage VRB for setting of the black level.

Figure 14:
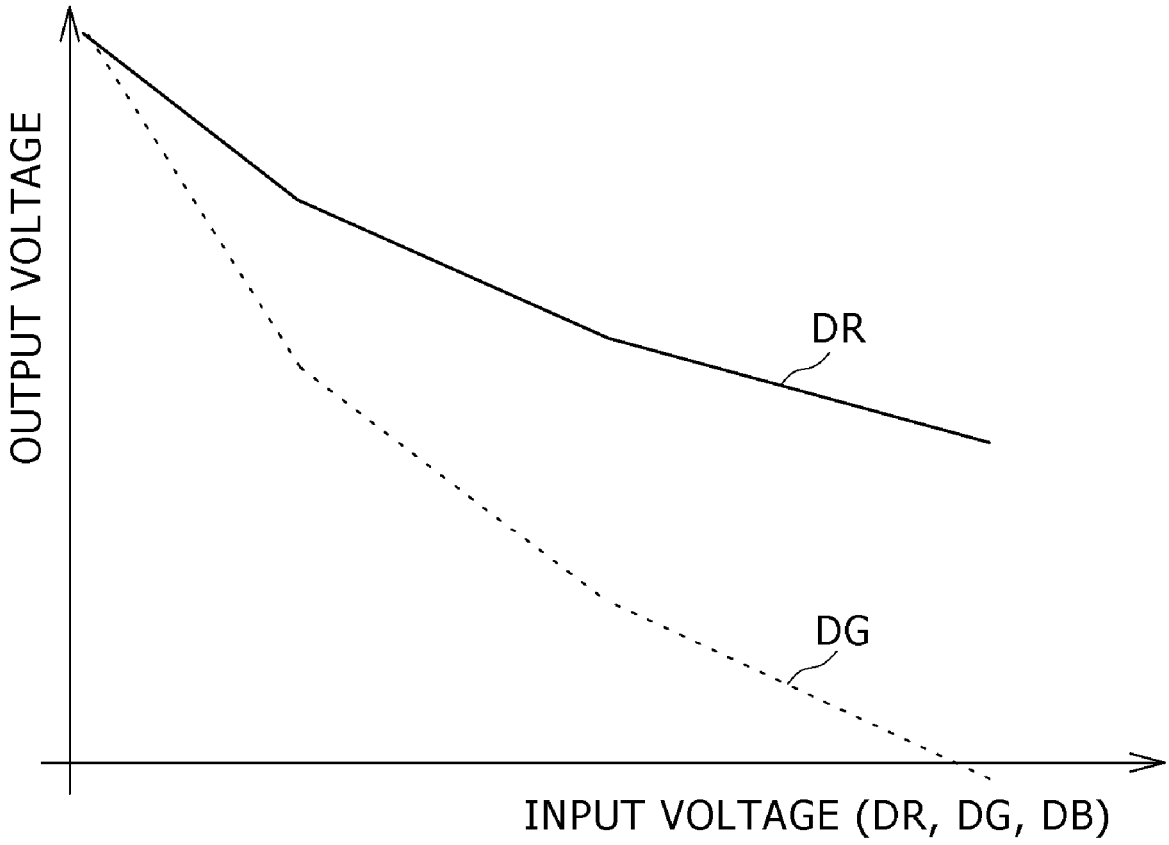
FIG. 14 is a characteristic curve diagram for explaining gamma adjustment in the display device according to the fifth embodiment of the present invention.

Due to this feature, in the display device of this embodiment, as shown in FIG. 14, the gamma characteristic is set as a so-called two-point broken line characteristic in such a way that intermediate grayscales closer to the black level and closer to the white level, and the white level can be adjusted on a color-by-color basis.

Also when the gamma characteristic is set as a two-point broken line characteristic and basic reference voltages for setting of the white level are generated for the respective color data like in this embodiment, the same advantages as those by the first embodiment can be achieved. Furthermore, the gamma can be adjusted more finely compared with the fourth embodiment.

Sixth Embodiment

In the above-described embodiments, a display device is formed by using organic EL elements as current-driven light-emitting elements. However, the present invention is not limited thereto but can be widely applied to display devices in which any of various kinds of current-driven light-emitting elements is used.

The present invention relates to display devices and can be applied to a display device that employs current-driven light-emitting elements such as organic EL elements.

It should be understood by those skilled in the art that various modifications, combinations, sub-combinations and alterations may occur depending on design requirements and other factors insofar as they are within the scope of the appended claims or the equivalents thereof.

What is claimed is:

1. A display device in which image data is subjected to digital-analog conversion processing to produce a drive signal and a display part formed by arranging pixels each employing a current-driven light-emitting element in a matrix is driven based on the drive signal, the display device comprising:

a basic reference voltage generation circuit configured to generate a plurality of basic reference voltages by varying a voltage in accordance with control data; and a plurality of voltage divider circuits configured to each produce a plurality of reference voltages by dividing the plurality of basic reference voltages by resistors, for a respective one of color data included in the image data; wherein at least the basic reference voltage corresponding to a black level is supplied to the plurality of voltage divider circuits in common, and the basic reference voltages closer to the black level than a voltage corresponding to a center value of the drive signal are each supplied to a respective one of the plurality of voltage divider circuits for a respective one of the color data.

2. The display device according to claim 1, wherein the basic reference voltage corresponding to a white level is supplied to the plurality of voltage divider circuits in common.

3. The display device according to claim 1, wherein the basic reference voltages corresponding to a white level are each supplied to a respective one of the plurality of voltage divider circuits for a respective one of the color data.

4. The display device according to claim 1, wherein the plurality of basic reference voltages are composed of the basic reference voltage corresponding to the black level, the basic reference voltage corresponding to a white level, and the basic reference voltages closer to the black level than the voltage corresponding to the center value of the drive signal.

5. The display device according to claim 1, wherein the plurality of basic reference voltages are composed of the basic reference voltage corresponding to the black level, the basic reference voltage corresponding to a white level, the basic reference voltages closer to the black level than the voltage corresponding to the center value of the drive signal, and the basic reference voltages closer to the white level than the voltage corresponding to the center value of the drive signal.

* * * * *